US009923265B2

(12) United States Patent
Jamaly

(10) Patent No.: US 9,923,265 B2
(45) Date of Patent: Mar. 20, 2018

(54) LOW-PROFILE ANTENNAS

(71) Applicant: Swisscom AG, Bern (CH)

(72) Inventor: Nima Jamaly, Bern (CH)

(73) Assignee: SWISSCOM AG (CH)

( * ) Notice: Subject to any disclaimer, the term of this patent is extended or adjusted under 35 U.S.C. 154(b) by 58 days.

(21) Appl. No.: 14/791,853

(22) Filed: Jul. 6, 2015

(65) Prior Publication Data

US 2016/0006114 A1 Jan. 7, 2016

(30) Foreign Application Priority Data

Jul. 3, 2014 (GB) ..... 1411941.6
Dec. 1, 2014 (EP) ..... 14195658

(51) Int. Cl.

*H01Q 1/36* (2006.01)
*H01Q 1/48* (2006.01)
*H01Q 9/40* (2006.01)
*H01Q 13/08* (2006.01)

(52) U.S. Cl.

CPC ..... *H01Q 1/36* (2013.01); *H01Q 1/48* (2013.01); *H01Q 9/40* (2013.01); *H01Q 13/08* (2013.01)

(58) Field of Classification Search

CPC ..... H01Q 13/08; H01Q 1/36; H01Q 1/48; H01Q 9/40; H01Q 1/22
USPC ..... 343/700 MS, 773, 789, 846, 848
See application file for complete search history.

(56) References Cited

U.S. PATENT DOCUMENTS 3,942,180 A 3/1976 Rannou et al.
4,225,869 A * 9/1980 Lohrmann ..... H01Q 21/08 343/773
5,506,592 A * 4/1996 MacDonald ..... H01Q 21/205 343/795
5,523,767 A 6/1996 McCorkle
6,011,524 A 1/2000 Jervis
6,072,405 A 6/2000 Sears
(Continued)

FOREIGN PATENT DOCUMENTS

CN 201562752 8/2010
CN 201859942 6/2011
(Continued)

OTHER PUBLICATIONS

European Search Report for Application No. GB1411941.6, dated Aug. 27, 2014, 6 pages.
(Continued)

*Primary Examiner* — Tho G Phan
(74) *Attorney, Agent, or Firm* — McAndrews, Held & Malloy, Ltd.

(57) ABSTRACT

Methods and systems are provided for low-profile or hidden antennas, and for installation and use of such antennas in particular locations, such as surfaces of roadways, pavements, walls, and/or ceilings. An example antenna system may comprise a ground conductor configured to provide a ground plane for the antenna system, where the ground conductor comprises a recess, a monocone arranged in the recess of the ground conductor, and a conductive coupling between the monocone and the ground conductor to ground the monocone. A geometrical configuration of one or more components of the antenna system may be selected adaptively to set (or select) one or more property of the antenna—e.g., resonance property of the antenna.

21 Claims, 4 Drawing Sheets

(56) References Cited

U.S. PATENT DOCUMENTS

| | | | | |
|---|---|---|---|---|
| 6,198,454 | B1 * | 3/2001 | Sharp | H01Q 13/04 343/773 |
| 6,369,769 | B1 | 4/2002 | Nap et al. | |
| 7,215,294 | B2 * | 5/2007 | Jocher | H01Q 1/36 343/773 |
| 9,356,354 | B2 * | 5/2016 | Yona | H01Q 9/40 |
| 2002/0109643 | A1 * | 8/2002 | Buckles | H01Q 9/46 343/893 |
| 2005/0156804 | A1 | 7/2005 | Ratni et al. | |
| 2012/0313823 | A1 | 12/2012 | Armstrong et al. | |

FOREIGN PATENT DOCUMENTS

| | | | |
|---|---|---|---|
| CN | 103066379 | | 4/2013 |
| EP | 1189305 | A2 | 3/2002 |
| EP | 2175521 | A1 | 4/2010 |
| FR | 2501422 | | 9/1982 |
| GB | 2453778 | A | 4/2009 |
| GB | 2484401 | | 4/2012 |
| JP | 2005094745 | | 4/2005 |
| JP | 2006080958 | | 3/2006 |
| WO | 2009143216 | A | 11/2009 |

OTHER PUBLICATIONS

European Search Report dated Feb. 17, 2016 for European Patent Application No. EP15178943.

* cited by examiner

LOW-PROFILE ANTENNAS

CLAIM OF PRIORITY

Pursuant to 35 U.S.C. § 119, this patent application claims the filing date benefit of and right of priority to United Kingdom (GB) Patent Application No. 1411941.6, dated Jul. 3, 2014, and European (EP) Patent Application No. 14195658.1, dated Dec. 1, 2014. Each of the above identified applications is hereby incorporated herein by reference in its entirety.

TECHNICAL FIELD

The present disclosure relates to communications. In particular, various embodiments in accordance with the present disclosure relate to methods and systems for implementing of low-profile or hidden antennas, and/or for installation and use of such antennas in particular locations, such as surfaces of roadways, pavements, walls, and/or ceilings.

BACKGROUND

The present disclosure relates to antennas. In this regard, there is a need to increase the capacity and/or coverage of telecommunications networks in highly populated areas (e.g., towns and cities). However, at the same time it may be desirable to avoid mounting telecommunications masts in public places and to reduce the costs associated with installation of such masts and/or related systems (e.g., costs associated with renting sites on which to install them).

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE DISCLOSURE

Systems and methods are provided for low-profile antennas, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

BRIEF DESCRIPTION OF THE DRAWINGS

Various features and advantages of the disclosure will become apparent from the following description of non-limiting exemplary embodiments, with reference to the appended drawings, in which.

DETAILED DESCRIPTION OF THE DISCLOSURE

Figure 1A:
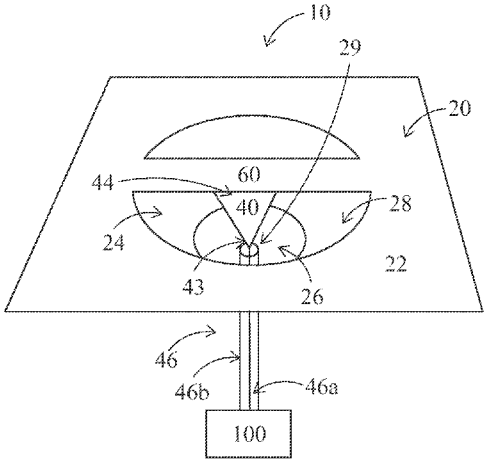
FIGS. 1A and 1B illustrate different schematic elevated cross-section views of an example antenna apparatus.

As utilized herein the terms "circuits" and "circuitry" refer to physical electronic components (e.g., hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y." As another example, "x, y, and/or z" means any element of the seven-element set {(x), (y), (z), (x, y), (x, z), (y, z), (x, y, z)}. In other words, "x, y and/or z" means "one or more of x, y, and z." As utilized herein, the term "exemplary" means serving as a non-limiting example, instance, or illustration. As utilized herein, the terms "for example" and "e.g." set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by a user-configurable setting, factory trim, etc.). In the context of the present disclosure, the term "coupling" (in particular an electrical coupling) may comprise indirect couplings and/or direct physical connections.

Embodiments in accordance with the present disclosure provide systems and methods for low-profile and/or hidden antennas, as described in the following in more detail with reference to the attached figures. Systems incorporating such low-profile and/or hidden antenna may be configured for installation in certain areas where use of low-profile and/or hidden antennas may be desirable and/or necessary. For example, systems incorporating low-profile and/or hidden antenna implemented in accordance with the present disclosure may be installed in (or on) surfaces, such as in a surface of a wall, a road or a maintenance cover for an access hole in a roadway such as a manhole.

In an example embodiment, a low-profile and/or hidden antenna system may be implemented using a DC grounded antenna comprising a monocone suspended in a recess of a ground plane by an electrically conductive holder.

In some example embodiments, low-profile and/or hidden antenna systems may be arranged such so that these system do not project beyond the surface into which they are to be installed.

In some example embodiments, a low-profile and/or hidden antenna system implemented in accordance with the present disclosure may comprise a monocone antenna and a ground conductor. The ground conductor may comprise a recess, and the monocone antenna may be seated in this recess. The broader, non-driven, end of the monocone may be arranged toward the mouth of the recess, where it may be conductively coupled to the ground conductor by the holder.

In an example embodiment, the conductive coupling between the monocone antenna and the ground conductor may comprise some resistive and/or some inductive impedance. The monocone itself may be capacitively coupled to the ground conductor, such as by capacitive coupling between the sides of the monocone and sidewalls of the recess for example.

In an example embodiment, the recess in the ground plane may comprise a hollow frustum, for example a frustoconical form, open at its mouth and closed at its base. The recess may be provided in an otherwise flat ground conductor. Although the recess is generally a complementary shape to the monocone, the slope angle of the walls of the recess may be selected to be different from the slope angle of the sides of the monocone. The slope of at least one of (a) the sides of the monocone and (b) the sides of the recess may be selected to tune the antenna, and/or to select its bandwidth and/or input impedance.

In an example embodiment, an aperture may be provided through the closed base of the recess to enable a transmission line to couple a driving signal to the monocone. The transmission line may comprise a core conductor surrounded by a conductive shield, for example the transmission line may comprise a coaxial cable. This core conductor may be coupled to drive the monocone antenna while the shield of the transmission line is conductively coupled to the ground plane, for example at the base of the recess.

The monocone antenna may be conductively coupled to the ground conductor at the mouth of the recess, for example by the holder which may at least partially cover the monocone. In these embodiments the monocone antenna, and signal drive circuitry, may be electrically shielded by the ground conductor and so protected from damage by high power electrical signals.

The holder, which may support the monocone in the recess, may comprise the conductive coupling between the monocone and the ground conductor. The inductive and/or resistive impedance of the holder may be selected to tune the antenna systems. In an example embodiment the holder may comprise a conductor and the dimensions, for example the length or width, of this conductor may be selected to modify its impedance and so tune the antenna.

The ground conductor may comprise an outer surface provided by an extended conductor, which may be flat, for example a sheet or plate of a conductor such as metal, which surrounds and extends outwardly from the mouth of the recess. For example, the mouth of the recess may be surrounded by a conductive outer surface, for example in the form of a rim, which may be flat. When installed in a surface, this conductive surface may be arranged to correspond to the shape of the surface in which the antenna system is to be installed. For example, where the antenna system is to be installed in a flat surface this extended conductive surface may comprise a flat conductor. This extended conductor may be configured to lie flush with the surface into which the antenna system is to be installed, while the recess and the monocone may be arranged behind the plane of that surface. The holder may be arranged in the plane of this extended conductive surface of the ground conductor.

In an example embodiment, an antenna system may be provided which may be installed in a cavity of a conductive grid, such as a maintenance hatch or manhole, whose outer surface extends away from the cavity.

In an example embodiment, an antenna system may be provided which may be formed integrally with a conductive grid such as a maintenance hatch. Such antenna systems may comprise a conductive coupling between the monocone and the conductive surface extending from the recess to provide a conductive (e.g., resistive and/or inductive) path to ground from the monocone.

Figure 1B:
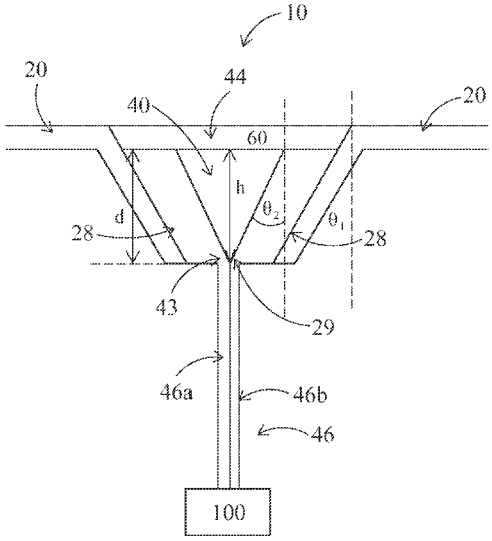

FIGS. 1A and 1B illustrate different schematic elevated cross-section views of an example antenna system. Shown in FIGS. 1A and 1B are an antenna system 10, a transmission line 46, and a transmission assembly 100.

The antenna system 10 may comprise suitable components (as well as circuitry) for implementing various aspects of the present disclosure. With reference to the example implementation illustrated in FIGS. 1A and 1B, the antenna system 10 may comprise a ground conductor 20, a monocone 40 and a holder 60. The transmission line 46 couples the antenna system 10 to the transmission assembly 100, which is described in more detail below.

The ground conductor 20 comprises a recess 24. The monocone 40 comprises a body, which may taper outwardly in a cone shape or frustum from a narrow end 43 to a head 44 that is broader than the narrow end 43. The monocone 40 may be positioned in the recess 24, being held in place by the holder 60. The holder 60 extends across the mouth of the recess 24 and supports the monocone 40 within the recess 24, with its head 44 nearer to the mouth of the recess 24 and its narrow end 43 nearer the bottom 26 of the recess 24.

The bottom 26 of the recess 24 may have an aperture 29 allowing the transmission line 46 to couple to the antenna system 10. The transmission line 46 may be any of various suitable types of lines (connectors) for connecting the antenna system 10 and transmission assembly 100. For example, as shown in FIGS. 1A and 1B the transmission line 46 may be a coaxial cable, comprising an inner conductor 46*a* and an outer conductive shield 46*b*. The inner conductor 46*a* may extend through the aperture 29 to electrically couple to the narrow end 43 of the monocone. The outer conductive shield 46*b* may be electrically coupled to the ground conductor 20, for example around or near the perimeter of the aperture 29.

The transmission assembly 100 may comprise suitable circuitry configured to supply a driving signal to the monocone 40 from its narrow end 43.

The ground conductor 20 may be configured to provide a ground plane for the antenna system 10 and comprises an electrically conductive material. The holder 60 also comprises an electrically conductive material. The holder 60 is electrically coupled to the ground conductor 20 and so grounds the monocone 40.

As shown in the example implementation illustrated in FIGS. 1A and 1B, the outer conductive shield 46*b* of the transmission line may be conductively coupled to the ground conductor 20. Either or both of the shield 46*b* and the ground conductor 20 may be grounded when the antenna system is installed. In this way, all parts of the antenna system 10 may be grounded (with the exception of the "feed point" where the inner conductor 46*a* connects to the narrow end 43 of the monocone 40). This may protect the antenna system 10 against damage from exposure to high voltages, for example from lightning strikes or from high voltage overhead cables located near the installation site of the antenna system. It may also reduce the possibility of the ground plate being at high voltage accidentally or undesirably.

Antenna systems implemented in accordance with the present disclosure may have no need for, or have a reduced need for a balun (balance-unbalance) component for the feed points of the antenna systems. For example, the ground conductor 20 of the antenna system 10 may be connected to the outer conductive shield 46*b* of the transmission line and the monocone 40 is connected to the inner conductor 46*a*.

In an example implementation, the ground conductor 20 may be configured to be sufficiently robust, such as to support the weight of at least an adult human being (e.g., a weight of at least 100 Kg), to support the weight of a road vehicle such as a car (e.g., at least 500 Kg). The recess 24 may be arranged in the middle of the ground conductor 20, for example the ground conductor 20 may be at least partially symmetric about the recess 24. The holder 60 may be symmetrically disposed across the recess 24.

In an example implementation, the ground conductor 20 may be configured to reduce undesired diffraction and so reduce the amount of radiation diffracted from edges of the ground conductor 20 that could interact with the transmitted radiation of the antenna system 10. The ground conductor 20 may extend away from the recess 24 to space the perimeter of the ground conductor 20 from the recess 24. For example, the ground conductor 20 may extend away from the recess 24, by distance having particular value or meeting particular criteria (e.g., at least 3 cm, at least 4 cm, at least 5 cm, less than 1 meter, less than 50 cm, less than 20 cm, etc.).

The perimeter of the ground conductor 20 may be circular or rectangular, for example square, or another regular or irregular shape.

As shown in the example implementation illustrated in FIGS. 1A and 1B, the ground conductor 20, excepting the recess 24, may be planar. The recess 24 comprises a sidewall 28 which tapers inwardly away from the mouth to the bottom 26 of the recess 24, which may be flat. FIG. 1B shows the taper angle $\theta_1$ of the sidewall 28 as measured from an axis of the recess 24. Accordingly, in the example implementation illustrated in FIGS. 1A and 1B, the sidewall may define a frusto-conical form in which the monocone 40 is arranged.

The holder 60 extends over the head 44 of the monocone 40 and may provide a protective cover to the monocone 40. For example, the holder 60 may comprise a metal bar arranged to span the recess 24 and to cover the head 44 of the monocone 40. In the example implementation illustrated in FIGS. 1A and 1B, the holder 60 is conductively coupled to the ground conductor 20, and as such it may electrically (as well as mechanically) shield the monocone 40 and the transmission assembly 100 that drives it. In other example implementations, however, some dielectric may be present to reduce empty space around the monocone 40.

The holder 60 may be arranged across the mouth of the recess 24 and may be rigid. The holder 60 may carry the monocone 40 such that the monocone is spaced from the sidewall 28 and from the bottom 26 of the recess 24. Holding the monocone 40 in this way may mean that there may be no need, in the antenna systems implemented in accordance with the present disclosure, to include any (lossy) dielectric to support the monocone 40, or to insulate it from the ground conductor 20. Instead, the monocone 40 may be suspended in the recess 24 by the conductive holder 60.

The holder 60 may extend across the diameter of the monocone 40. For example the holder 60 may be arranged symmetrically with respect to the monocone 40 and/or with respect to the recess 24. The holder 60 may be configured to protect the monocone 40 from mechanical shocks and/or electrical damage. In the example implementation illustrated in FIGS. 1A and 1B, the holder 60 is arranged such that its outer surface is flush with the plane of the ground conductor 20. The holder 60 may be arranged such that the monocone 40 is centrally aligned in the recess 24, for example such that the axis of the monocone 40 is arranged along a central axis of the recess 24.

The mouth of the recess 24 may not be closed by the holder 60, so a region of the mouth typically remains open either side of the holder 60.

The monocone 40 is arranged as a monopole antenna comprising a conical body of conductive material arranged to be driven by a radio frequency signal coupled to the narrow end 43 of the monocone 40 by the transmission line 46. In the illustrated example, the transmission line 46 comprises a coaxial cable. In other examples, the transmission line may be differently configured to provide a driving signal to the monocone.

The monocone 40 may be a wideband antenna, for example. In an example implementation, the width of the holder 60 may be selected based on the desired bandwidth of the antenna system 10. In this regard, the antenna system 10 may have a bandwidth comprising at least one frequency band corresponding to a particular telecommunications protocol—e.g., 900 MHz, 1800 MHz, 2100 MHz, 2600 MHz and 3500 MHz bands.

As shown in FIG. 1B, the monocone 40 has a taper angle $\theta_2$ as measured from an axis of the monocone 40 and a height h. The body of the monocone 40 is spaced from the sidewall 28. The taper angle $\theta_2$ of the monocone 40 may be the same as or different to the taper angle $\theta_1$ of the recess 24.

The monocone 40 is arranged so that it does not project beyond the mouth of the recess 24. In some examples, the height h of the monocone 40 may be selected to be smaller than the depth d of the recess 24. Antenna system described herein may therefore be inherently low profile in that the monocone 40 does not extend through the plane of the ground conductor 20.

In some example implementations, the height h of the monocone 40 may be adaptively selected to have particular value or meet particular criteria—e.g., is less than 10 cm, less than 8 cm, less than 6 cm, less than 5 cm, or, for example about 4 cm or less. In some example implementations, the height h of the monocone may be at least 1 cm, such as, for example at least 2 cm, or, for example at least 3 cm.

The geometric configuration of the antenna system 10 and the dimensions of its components (including the width, length, shape and thickness of the holder 60, the base diameter and height h of the monocone 40 and the respective taper angles $\theta_1$, $\theta_2$ of the sidewall 28 and monocone 40, and the separation of the monocone 40 from the sidewall 28) may each affect this capacitive coupling. In addition, the geometry of the holder 60 may affect the inductance and resistance of the conductive coupling it provides from the head 44 of the monocone 40 to the ground conductor 20. These parameters may affect a resonance property, such as tuning, bandwidth, amplitude, a radiation profile or a specific frequency or a resonant frequency of the antenna system 10. Accordingly, each of these parameters may be selected so that the antenna system 10 provides a selected resonance property, for example a desired bandwidth or a resonant frequency.

Each of these parameters may affect the input impedance of the antenna (for example by modifying the impedance of an electrical pathway to ground through the monocone 40). In an example implementation, at least one of these parameters is selected based on the desired input impedance of the antenna system 10. The desired input impedance may be selected to match, or approximately match, that of a transmission line that is to be coupled to drive the antenna system 10. The desired input impedance may be determined based on a desired bandwidth. Therefore, in an example implementation, at least one of the parameters is selected in order to provide an input impedance that gives rise to a desired bandwidth.

In an example implementation, the following dimensions are selected to provide a selected resonance property, for example a desired bandwidth or a resonant frequency, of the antenna system 10: $\theta_1$, $\theta_2$, the height h of the monocone 40, the base diameter of the recess 24, the mouth diameter of the recess 24, the narrow-end diameter of the monocone 40 and the head-end diameter of the monocone 40.

By selecting appropriate values for $\theta_1$ and $\theta_2$, for example, bandwidths of the order, in some examples, 700 MHz and, in other examples, 550 MHz and, in other examples, 400 MHz may be provided. Other bandwidths are also possible and contemplated by the disclosure.

In some example antenna systems, the shape of the radiation pattern (spatial power distribution) may vary as a function of frequency across the bandwidth. In an example implementation, the dimensions listed above are selected to reduce the variation of this spatial power distribution as a function of frequency towards a situation in which the shape of the pattern of radiation may be constant, or approximately constant, throughout the one or more bandwidths of the antenna system 10. That is, the dimensions may be selected (e.g., by a processor of a computer system) such that the geometrical power distribution is frequency-independent across the one or more bandwidths of the antenna system 10. One example of a set of selected dimensions is provided in the following table:

TABLE 1 selected dimensions for example low-profile antenna

| Component | Dimensions | | |
|---|---|---|---|
| Holder | 120 mm (length) | 40 mm (width) | 2 mm (thickness) |
| Monocone | 6 mm (end 43) | 4 mm (head 44) | 30 mm (height) |
| Recess | 54 mm (base) | 120 mm (mouth) | 32 mm (height) |
| Ground Conductor | 150 mm (length) | 150 mm (width) | 2 mm (thickness) |

Use of these selected dimensions (e.g., in an implementation of the antenna system 10) may result an antenna having a bandwidth comprising frequencies between 1.8 GHz and 3.9 GHz. The directivity of such antenna may be around 7 to 8 dBi. Further, the shape of the pattern of the radiation may be approximately constant across each bandwidth. In addition, an antenna system having the above dimensions may demonstrate (or show) slight variation of spatial power distribution as a function of frequency. Thus, the shape of the radiation pattern may be constant or approximately constant throughout the bandwidth of the antenna system 10. That is, for the current configuration, the geometrical radiation power distribution is frequency independent across one or more bandwidths of the antenna system.

Figure 2:
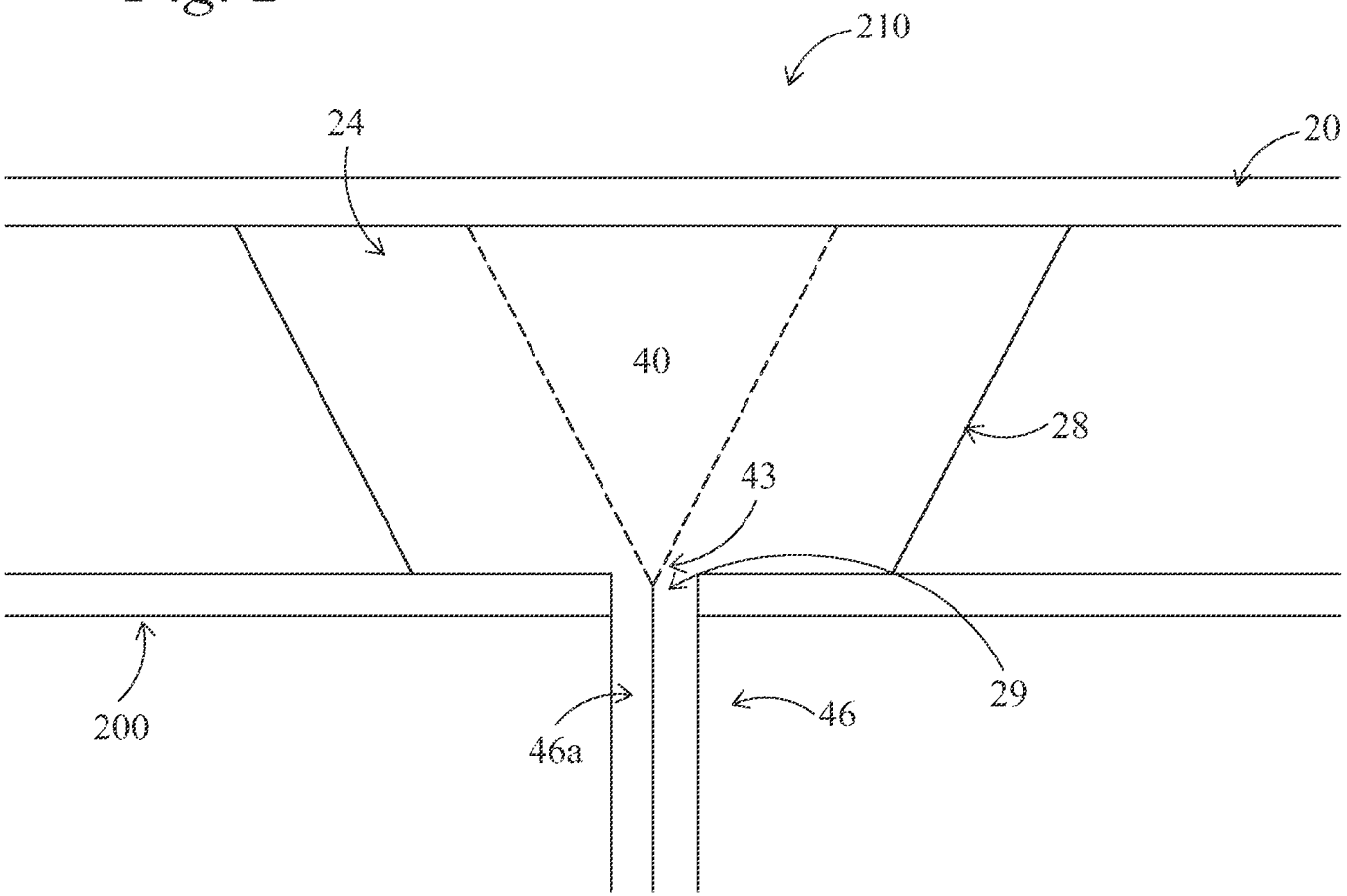
FIG. 2 illustrates a schematic section view of an example antenna apparatus.

FIG. 2 illustrates a schematic section view of an example antenna system. Shown in FIG. 2 is an antenna system 210.

The antenna system 210 may be substantially similar to the antenna system 210 of FIGS. 1A and 1B. As such the antenna system 210 is shown as comprising at least some of the same components or elements as the antenna system 10 (and thus having the same reference numbers)—e.g., the ground conductor 20 (with the recess 24, which may have the aperture 29 for allowing the transmission line 46 to couple to the antenna system 210), the monocone 40 (with the narrow end 43 and the head 44), etc. However, the antenna system 210 may also comprise a second ground conductor 200, which may be spaced from the ground conductor 20 by the depth of the recess 24.

As shown in the example implementation illustrated in FIG. 2, the sloping wall 28 of the recess 24 slopes towards the second ground conductor 200, which may provide the bottom surface of the recess 24. The second ground conductor 200 comprises the aperture 29 which is arranged to receive the inner conductor 46*a* of the transmission line 46, to allow the inner conductor 46*a* to connect with the narrow end 43 of the monocone 40 (which is shown supported within the recess 24 in dashed lines).

The antenna system 210, as described herein, may be installed into a cavity in a surface of a maintenance cover such that the ground conductor 20 is flush with the surface of the maintenance cover. In instances where the maintenance cover is electrically conductive, the outer perimeter of the ground conductor 20 may be effectively provided by the outer perimeter of the maintenance cover. Accordingly, the edge of the conductive surface is spaced from the mouth of the recess 24, which may reduce the contribution of diffracted radiation on the overall waveform emitted by the antenna system 210.

When installed, for example in the surface of a road, the monocone antenna 40 may be supported beneath the holder 60 (not shown) and beneath the plane of the ground conductor 20 and the plane of the road. The antenna system 210 may be configured or arranged such that the monocone antenna 40 does not project above the plane of the ground conductor 20 or the plane of a surface into which the antenna system 210 is installed. In such configuration, the monocone antenna 40 may be protected by the holder 60.

The holder 60 may be sufficiently robust to support the weight of road vehicles such as cars so that these may pass over the antenna system 210 without compromising the physical integrity of the apparatus.

In another example implementation, the ground conductor (20,200) may comprise a block of conductive material. The recess 24 may comprise a cavity in this block.

Figure 3:
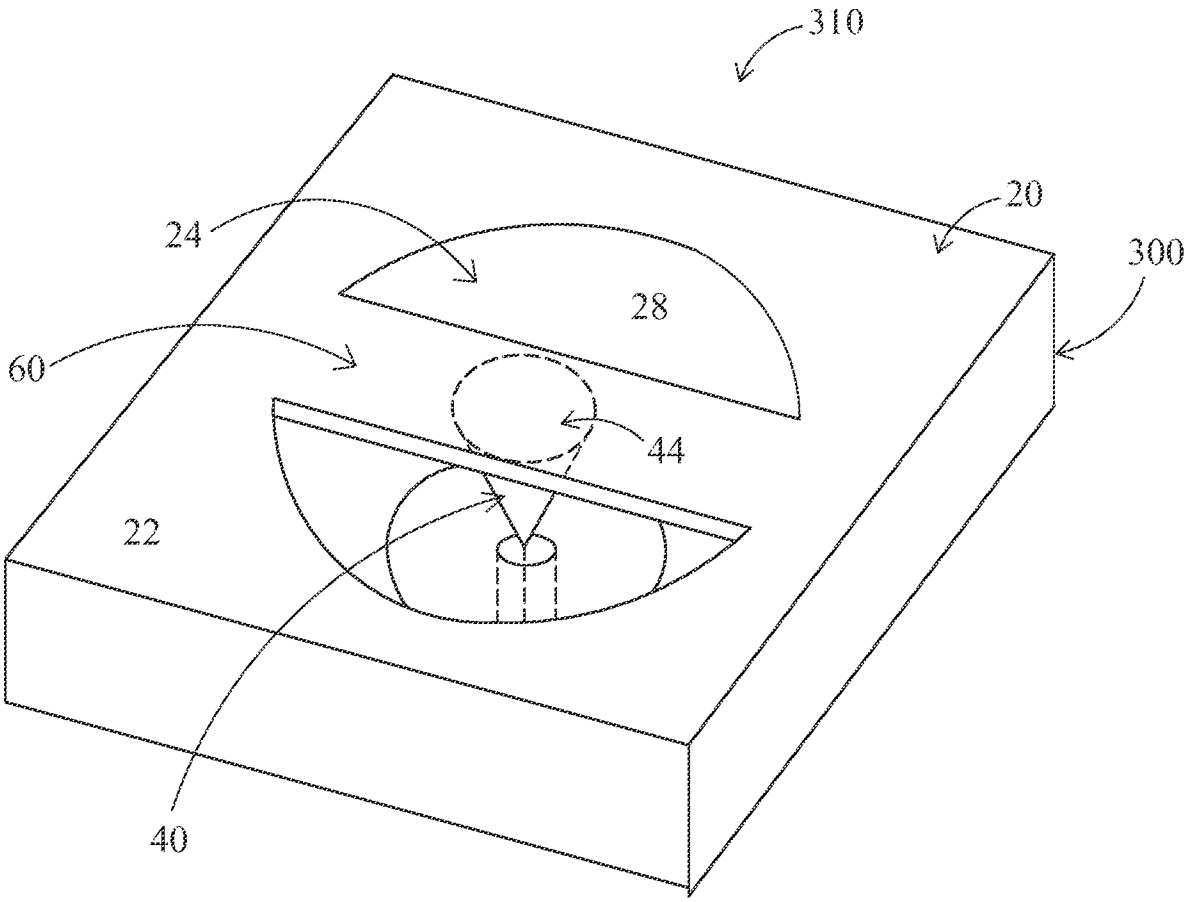
FIG. 3 illustrates a schematic elevated view of an example antenna apparatus.

FIG. 3 illustrates a schematic elevated view of an example antenna system. Shown in FIG. 3 is an antenna system 310.

The antenna system 310 may be substantially similar to the antenna system 10 of FIGS. 1A and 1B. As such the antenna system 310 is shown as comprising at least some of the same components or elements as the antenna system 10 (and thus having the same reference numbers)—e.g., the ground conductor 20 (with the recess 24, which may have the aperture 29 for allowing the transmission line 46 to couple to the antenna system 310), the monocone 40 (with the head 44), the sidewall 28, the holder 60, etc.

As shown in the example implementation illustrated in FIG. 3, the antenna system 310 may be integrated in a maintenance cover. The maintenance cover comprises a block 300 of conductive material. The outer surface of the block 300 provides the ground conductor 20. The recess 24 is formed in the block 300 and the holder 60 extends across the recess 24, the holder 60 carrying the monocone 40 so that the monocone 40 is supported in the recess 24 in a spaced relationship to the sidewall 28. The holder 60 fixes the monocone 40 relative to the sidewall 28 and to the upper surface of the block 300 and holds the body of the monocone 40 beneath the outer surface of the block 300 (e.g., beneath the outer surface of the maintenance cover). The holder 60 thereby provides a protective surface across the head 44 of the monocone.

In an example implementation, the antenna system illustrated in FIG. 3 may be manufactured by forming a frustoconical or conical recess in the block 300, or by molding the block 300 so as to have the recess. The base of this recess may serve as a further ground plate.

In various example embodiments of antenna systems in accordance with the present disclosure a radiation pattern may be provided which may be polarized in particular manner—e.g., in the direction of the axis of the monocone 40. That is, for each illustrated example antenna systems (in FIGS. 1A to 3), a radiation pattern may be provided which is polarized at 90° to the ground conductor 20.

The holder 60 may impose an electrical boundary on the antenna systems implemented in accordance with the present system. The antenna systems illustrated in any of FIGS. 1A to 3 may therefore have a null point at the center of its profile (θ=0).

Figure 4:
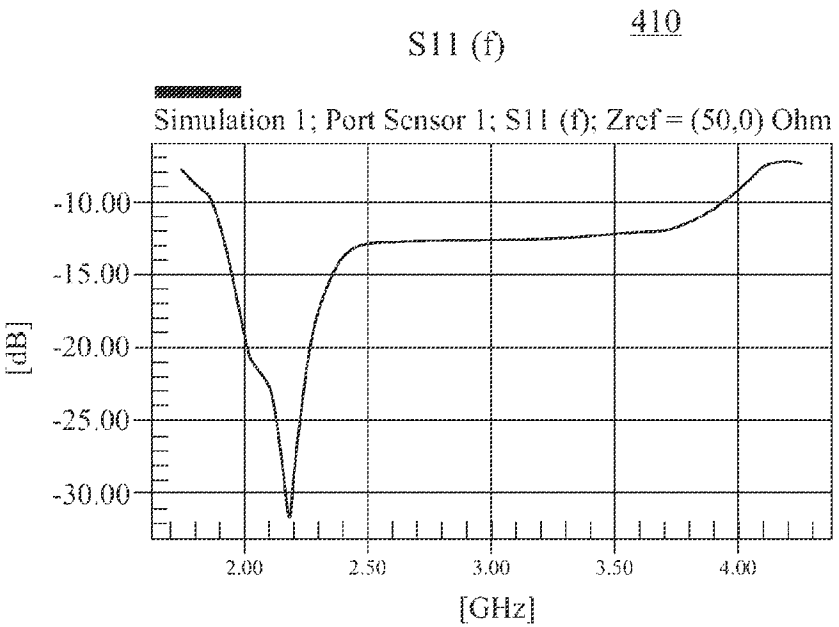
FIG. 4 illustrates an example plot of a radiation profile of a monocone antenna, in according to the present disclosure.
Figure 4:
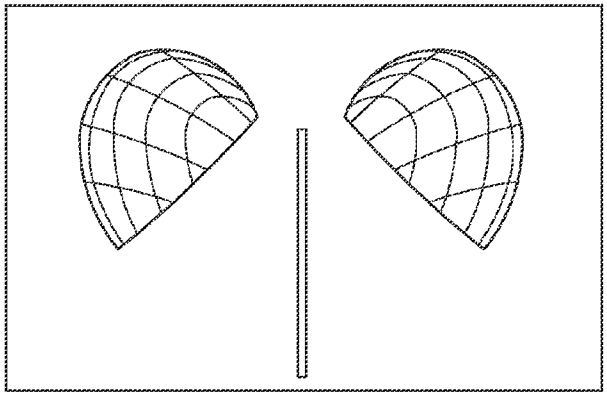

FIG. 4 illustrates an example plot of a radiation profile of a monocone antenna, in according to the present disclosure. Shown in FIG. 4 are a radiation profile 400 and a simulation chart 410.

The radiation profile 400 may represent radiation of an antenna system implemented in accordance with the present disclosure (e.g., one of the example antenna systems 10, 210, and 310). Further, the simulation chart 410 illustrates example simulation associated with an antenna system implemented in accordance with the present disclosure, such as an antenna system having the radiation profile 400. In this regard, the radiation emitted by the antenna system 10, 210, 310 may be predominantly polarized parallel to the axis of the monocone 40, for example predominantly vertically polarized. Thus, where the antenna system 10, 210, 310 is installed at ground level, the emitted radiation may not as be severely blocked by nearby objections—e.g., vehicles parking or passing over the antenna system 10, 210, 310.

In the particular illustrated example radiation profile, the radiation pattern may be null in two planes. The first plane is the azimuth plane (aligned with the plane of the ground conductor 20). The second plane is a vertical plane which coincides with the holder axis and is normal line to the plane of the ground conductor 20. In this example, θ=0 is on the cross-section between these two planes.

Accordingly, the antenna system 10, 210, 310 may be installed in a cavity such as a maintenance access hole in a roadway. Once installed, the monocone 40 is at least partially disposed in the cavity and is arranged under, or behind, the holder 60—that is, under or behind the place of the ground conductor 20. This may provide electrical shielding to protect the monocone 40 from being damaged, such as by high power electrical signals, for example. In addition the antenna may be mechanically protected from physical contact and weather. Further, the antenna system may be provided in a cover for such a maintenance hole, for example by a manhole cover.

In various implementations, certain aspects of the antenna systems implemented in accordance with the present disclosure may differ from aspect described in conjunction with the example illustrated embodiments.

In some example implementations, the ground conductor 20 may comprise a horn-shaped ground conductor.

In some example implementations, the head 44 of the monocone 40 may be non-conductively connected to the ground conductor 20. For example, an electrically insulating holder may support the monocone 40 in its recess 24. This may be provided in addition to, or as an alternative to, the conductive holder 60 described above.

In some example implementations, the monocone 40 described herein may be replaced by other types (of antenna), such as other monopole antennas, for example.

In some example implementations, the recess 24 may be open-ended—that is the base need not be closed, for example. In some implementations, the recess 24 and the antenna may be differently shaped than in the illustrated example embodiments.

In some example implementations, the ground conductor 20 may not be planar or flat, and may comprise ridges and/or grooves which circumscribe the recess 24.

The stem of the monocone 40 (e.g., the narrower end, or tip, from which the antenna system 10, 210, 310 may be driven) may be conductively coupled to the ground conductor 20 via the broader end, or head 44, of the monocone 40. When a holder 60 is provided across, for example over, the monocone 40, the holder 60 may provide or comprise the conductive coupling.

Nonetheless, it should be understood that above described embodiments and/or implementations are to be understood as illustrative examples. Further embodiments and/or implementations are envisaged. It is to be understood that any feature described in relation to any one embodiment or implementation may be used alone, or in combination with other features described, and may also be used in combination with one or more features of any other of the embodiments and/or implementations, or any combination of any other of the embodiments and/or implementations. Further, equivalents and modifications not described above may also be employed without departing from the scope of the invention, which is defined in the accompanying claims.

Other embodiments of the disclosure may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein.

Accordingly, the present disclosure may be realized in hardware, software, or a combination of hardware and software. The present disclosure may be realized in a centralized fashion in at least one computer system, or in a distributed fashion where different units are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present disclosure may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present disclosure makes reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present disclosure not be limited to the particular embodiment disclosed, but that the present disclosure will include all embodiments falling within the scope of the appended claims.

What is claimed is:

1. An antenna system, comprising:

a ground conductor configured to provide a ground plane for the antenna system, the ground conductor comprising a recess;

a monocone arranged in the recess of the ground conductor; and a conductive coupling between the monocone and the ground conductor to ground the monocone;

wherein geometry of at least one of the monocone, the conductive coupling, and a spacing between the monocone and the recess is arranged to provide one or both of:

a selected resonance property of the antenna system; and a selected input impedance of the antenna system.

2. The antenna system of claim 1, wherein the conductive coupling is configured to hold the monocone spaced from a sidewall of the recess.

3. The antenna system of claim 2, wherein the sidewall of the recess and an end face of the recess define a hollow frustum.

4. The antenna system of claim 3, wherein an aperture is arranged in an end face of the frustum.

5. The antenna system of claim 4, wherein a tapering of the frustum is shallower than a tapering of the monocone.

6. The antenna system of claim 4, wherein a driven end of the monocone is arranged to be driven by a drive signal carried through the aperture.

7. The antenna system of claim 1, wherein:

a non-driven end of the monocone is coupled to the ground conductor by the conductive coupling; and a driven end of the monocone is coupled to the ground conductor by the non-driven end and the conductive coupling.

8. The antenna system of claim 1, wherein a width of the conductive coupling is selected based on a desired bandwidth of the antenna system.

9. The antenna system of claim 1, wherein a width of the conductive coupling is selected based on a desired coverage range of the antenna system.

10. The antenna system of claim 1, wherein the selected resonance property comprises one or both of: a selected resonant frequency, and a selected bandwidth.

11. The antenna system of claim 1, where at least a portion of the antenna system is incorporated into a cover for a maintenance access hole.

12. A method for configuring an antenna, the method comprising:

selecting by a processor, to select a resonance property of the antenna, a geometrical configuration of one or more of:

a ground conductor configured to provide a ground plane of the antenna;

a recess of the ground conductor;

a monocone to be arranged in the recess of the ground conductor;

a holder to be arranged between the monocone and the ground conductor to ground the monocone and to hold the monocone spaced from a sidewall of the recess; and a space between the monocone and the sidewall of the recess.

13. The method of claim 12, wherein the selected resonance property is one or more of: a tuning, bandwidth, amplitude, spatial power distribution, specific frequency, and resonant frequency of the antenna.

14. The method of claim 13, wherein the selected resonance property comprises the spatial power distribution of the antenna.

15. The method of claim 13, comprising selecting the geometrical configuration to reduce frequency-dependent variation in the spatial power distribution of the antenna for one or more bandwidths of the antenna.

16. The method of claim 12, comprising selecting the geometrical configuration is based on a desired input impedance of the antenna.

17. The method of claim 12, comprising selecting the geometrical configuration of the holder to provide a selected inductance.

18. The method of claim 17, wherein selecting the geometrical configuration of the holder comprises selecting one or more of: a width, length, shape, and thickness of the holder.

19. The method of claim 12, wherein selecting the geometrical configuration of the monocone comprises selecting one or more of: a base diameter, head diameter, and height of the monocone.

20. The method of claim 12, wherein selecting the geometrical configuration of the recess comprises selecting one or more of: a diameter of a base of the recess, a diameter of a mouth of the recess, a shape of the recess, a taper angle of the recess, and the depth of the recess.

21. The method of claim 12, wherein selecting the geometrical configuration of the space between the monocone and the sidewall of the recess comprises selecting one or more of: a taper angle of the recess, a taper angle of the monocone, and a separation of the monocone from the sidewall.

* * * * *